US006640153B2

(12) United States Patent
Kwak

(10) Patent No.: US 6,640,153 B2
(45) Date of Patent: Oct. 28, 2003

(54) EMBROIDERY MACHINE TECHNICAL-SUPPORT SYSTEM AND METHOD AND STORAGE MEDIUM TO IMPLEMENT THE METHOD

(75) Inventor: Su Moon Kwak, Inchon (KR)

(73) Assignee: Sunstar Precision Co., Ltd., Inchon (KR)

( * ) Notice: Subject to any disclaimer, the term of this patent is extended or adjusted under 35 U.S.C. 154(b) by 0 days.

(21) Appl. No.: 10/244,474

(22) Filed: Sep. 17, 2002

(65) Prior Publication Data

US 2003/0065418 A1 Apr. 3, 2003

(30) Foreign Application Priority Data

Sep. 29, 2001 (KR) ..... 2001-60889

(51) Int. Cl.[7] ..... G06F 19/00; D05B 19/12; D05B 21/00

(52) U.S. Cl. ..... 700/138; 112/102.5

(58) Field of Search ..... 700/138, 136, 700/137; 112/102.5, 470.04, 470.06, 470.01, 475.19, 445, 155

(56) References Cited

U.S. PATENT DOCUMENTS 5,662,055 A 9/1997 Hartwig et al.
6,196,146 B1 * 3/2001 Goldberg et al. ..... 112/102.5 X
6,445,970 B1 * 9/2002 Hedman et al. ..... 700/138

* cited by examiner

*Primary Examiner*—Peter Nerbun
(74) *Attorney, Agent, or Firm*—Harness, Dickey & Pierce, P.L.C.

(57) ABSTRACT

An embroidery machine technical support system includes at least one technical support server and a plurality of embroidery machines communicating with the technical support server through a public network. Each embroidery machine has an emulator in order for the embroidery machine to establish connection to the technical support server through the public network, receive a technical support page from the technical support server, send a technical information request signal to the technical support server using the technical support page, and receive corresponding technical information from the technical supporter server. The technical support server sends the technical support page when the embroidery machine establishes connection with the technical support server and sends technical information in response to the technical information request signal from the embroidery machine.

60 Claims, 13 Drawing Sheets

EMBROIDERY MACHINE TECHNICAL-SUPPORT SYSTEM AND METHOD AND STORAGE MEDIUM TO IMPLEMENT THE METHOD

FIELD OF THE INVENTION

The present invention relates to an embroidery machine, and in particular, to an embroidery machine technical support system and a method allowing at least an embroidery machine to communicate with a technical support server located at a remote service center which provides the embroidery machine with various information and a storage medium having stored therein computer executable instructions to implement the method.

DESCRIPTION OF THE PRIOR ART

Generally, an embroidery machine comprises an embroidery operation program for automatically embroidering an embroidery design. The embroidery machine includes a storage, an input unit, a controller, an embroidery machine, and a fault detector. The storage stores an embroidery design data. The input unit inputs an embroidery design selection signal, and an embroidery operation start/stop signal from the user. The controller controls the embroidery machine in response to a user's request. The embroidery machine embroiders the selected embroidery design. The fault detector detects the fault of the embroidery machine if the embroidery operation is stopped by the fault of the embroidery machine.

Where the user inputs the selected embroidery design and the embroidery operation start signal, the controller controls the embroidery operation program stored in the storage to embroider the selected embroidery design. If the embroidery operation is stopped by the fault of the embroidery machine, the controller controls the display unit for displaying a fault message of the embroidery machine. The user should repair the embroidery machine after checking the fault message. However, when the user cannot repair the embroidery machine, the user makes a phone call to a system administrator of service center in order to request a repair service.

In case a request for on-site repair by the user, the system administrator shall correctly understand the fault of the embroidery machine so as to bring a correct embroidery part for repair. However the user may not know which embroidery-part is broken. Even though the user notices the correct fault embroidery-part, the user may not know the embroidery-part name. If so, the user may not explain the embroidery technical support information to the system administrator in detail and the system administrator may misunderstand the fault of the embroidery machine.

In this situation, if the system administrator may bring a wrong embroidery part for on-site repair, the system administrator returns to the service center to bring a correct embroidery part. Furthermore, some cases where the user recognizes a fault of the embroidery machine, an unnecessary on-site repair may occur. As above, there is a problem that the system administrator incorrectly diagnoses the fault of the embroidery machine in case that the user incorrectly explains the technical support information to the system administrator. Accordingly, there is strongly needed an embroidery machine technical support system for efficiently diagnosing the fault of the embroidery machine.

SUMMARY OF THE INVENTION

The present invention has been made in an effort to solve the above problem.

It is an object of the present invention to provide an embroidery machine technical support system and method allowing an embroidery machine to communicate with a technical support server of a remotely located service center in accordance with an user's manipulation so as to receive various information related to the embroidery machine.

In accordance with a first aspect of the present invention, there is provided an embroidery machine technical support system for diagnosing a fault of an embroidery machine, comprising: a communication network; an embroidery system coupled to the communication network for indicating that an embroidery operation is stopped by the fault of the embroidery machine, displaying a emulator drive guide message, displaying a technical support web page received from the communication network in response to an emulator drive signal inputted by an user, and transmitting technical support information, inputted into the technical support web page by the user, to the communication network; and a technical support server coupled to the communication network for providing the technical support web page to the communication network, diagnosing the fault of the embroidery machine by employing the technical support information inputted into the technical support web page in order to generate technical support information, and transmitting the technical support information to the embroidery system through the communication network.

In accordance with a second aspect of the present invention, there is provided a method for diagnosing the fault of the embroidery machine, comprising the steps of: (a) detecting that an embroidery operation is stopped by the fault of the embroidery machine and displaying a emulator drive guide message; (b) displaying a technical support page in response to a emulator drive signal inputted by an user; (c) transmitting technical support information, inputted into the technical support web page by the user, from an embroidery system to a technical support server; and (d) transmitting the technical support web page from a technical support server to the embroidery system, diagnosing the fault of the embroidery machine by employing the technical support information inputted into the technical support web page in order to generate technical support information, and transmitting the technical support information to the embroidery system. In accordance with a third aspect of the present invention, there is provided a computer-readable medium storing program instructions, the program instructions disposed on a computer to perform a method for diagnosing the fault of the embroidery machine, comprising the steps of: (a) indicating that an embroidery operation is stopped by the fault of the embroidery machine and displaying a emulator drive guide message; (b) displaying a technical support web page in response to an emulator drive signal inputted by an user; (c) transmitting technical support information, inputted into the technical support web page by the user, from an embroidery system to a technical support server; and (d) transmitting the technical support web page from a technical support server to the embroidery system, diagnosing the fault of the embroidery machine by employing the technical support information inputted into the technical support web page in order to generate technical support information, and transmitting the technical support information to the embroidery system.

BRIEF DESCRIPTION OF THE DRAWINGS

The above and other objects and features of the instant invention will become apparent from the following description of preferred embodiments taken in conjunction with the accompanying drawings, in which.

DETAILED DESCRIPTION OF THE INVENTION

Figure 1:
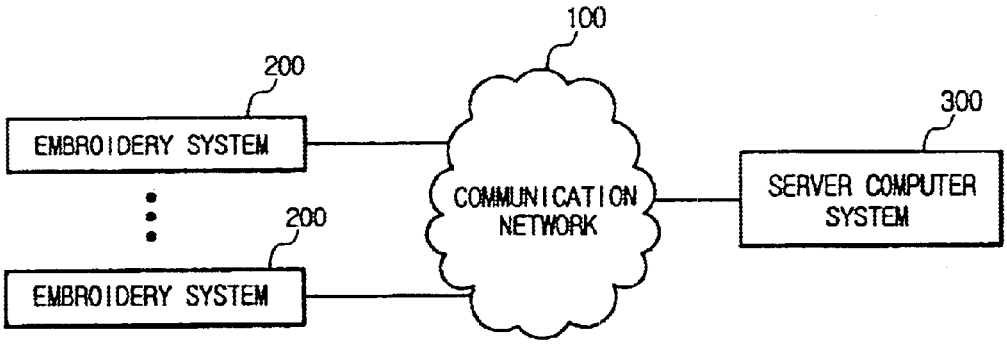
FIG. 1 is an exemplary block diagram illustrating an embroidery machine technical support system according to a preferred embodiment of the present invention.

Referring to FIG. 1, the embroidery machine technical support system comprises a plurality of embroidery machines 200 communicating with an technical support server 300 through a communication network 100. The embroidery machine 200 requests technical information to the technical support server 300 through the communication network 100 so as to receive corresponding technical information from the technical support server 300 in response to the request.

The embroidery machine 200 establishes connection to the technical support server 300 in response to a user's manipulation so as to receive the technical support page from the technical support server 300, such that the user requests technical support by filling out a request form in the technical support page. The technical support request signal is sent to the technical support server 300 such that the technical support server 300 responsively sends the requested information to the embroidery machine 200.

The technical support request signal can be embroidery machine information or trouble diagnosis information request signal.

Figure 2:
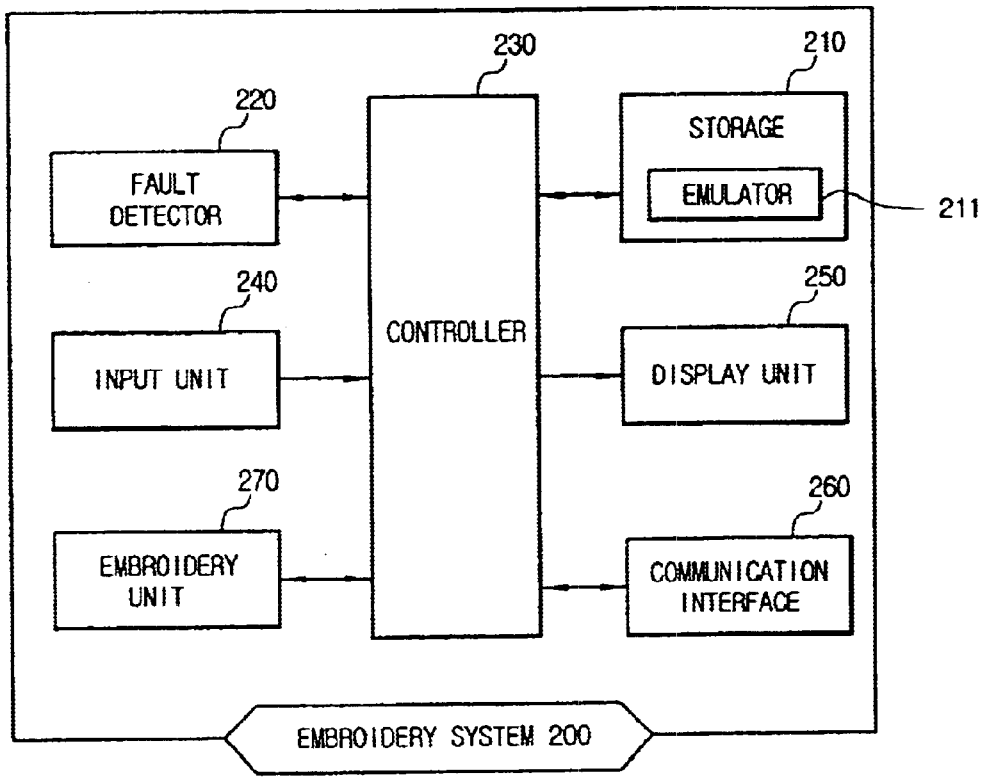
FIG. 2 is an exemplary block diagram illustrating an embroidery machine of the embroidery system shown in FIG. 1.

Referring to FIG. 2, the embroidery machine 200 includes a storage 210, a fault detector 220, a controller 230, an input unit 240, a display unit 250, a communication interface 260, and an embroidery machine 200.

The storage 210 has an emulator 211 which is activated in response to user's request in order for the embroidery machine to communicate with the technical support server 300, and stores the technical support information from the technical support server 300 through the emulator 211. The fault detector 220 detects a fault of the embroidery machine 200 if the embroidery operation is stopped by the fault of the embroidery machine 200. Then, the fault detector 220 produces and transmits a fault detection signal to the controller 230.

The controller 230 outputs the emulator drive guide message in response to the user's input signal inputted from the input unit 240 or the fault detection signal generated by the fault detector 220 so as to operate the emulator 211 for connecting the embroidery machine 200 to the technical support server 300.

The display unit 250 displays the fault detection signal, the emulator drive guide message, and the technical support web page from the technical support server 300.

The communication interface 260 receives the technical support information from the technical support server 300, and transmits the technical support request and the technical support information inputted through the input unit 240 and the fault detector 220 to the technical support server 300.

Figure 3:
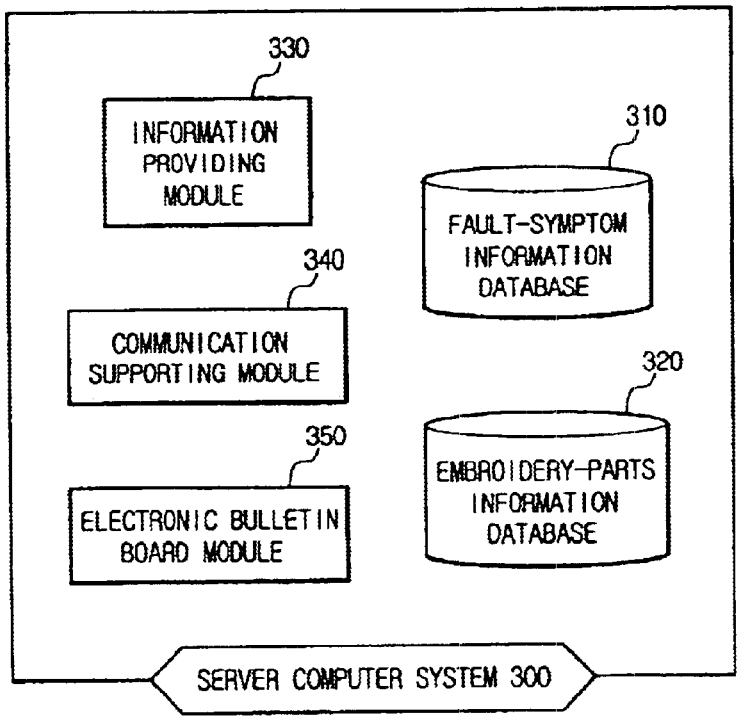
FIG. 3 is an exemplary block diagram illustrating a technical support server of the embroidery machine technical support system shown in FIG. 1.
Figure 4:
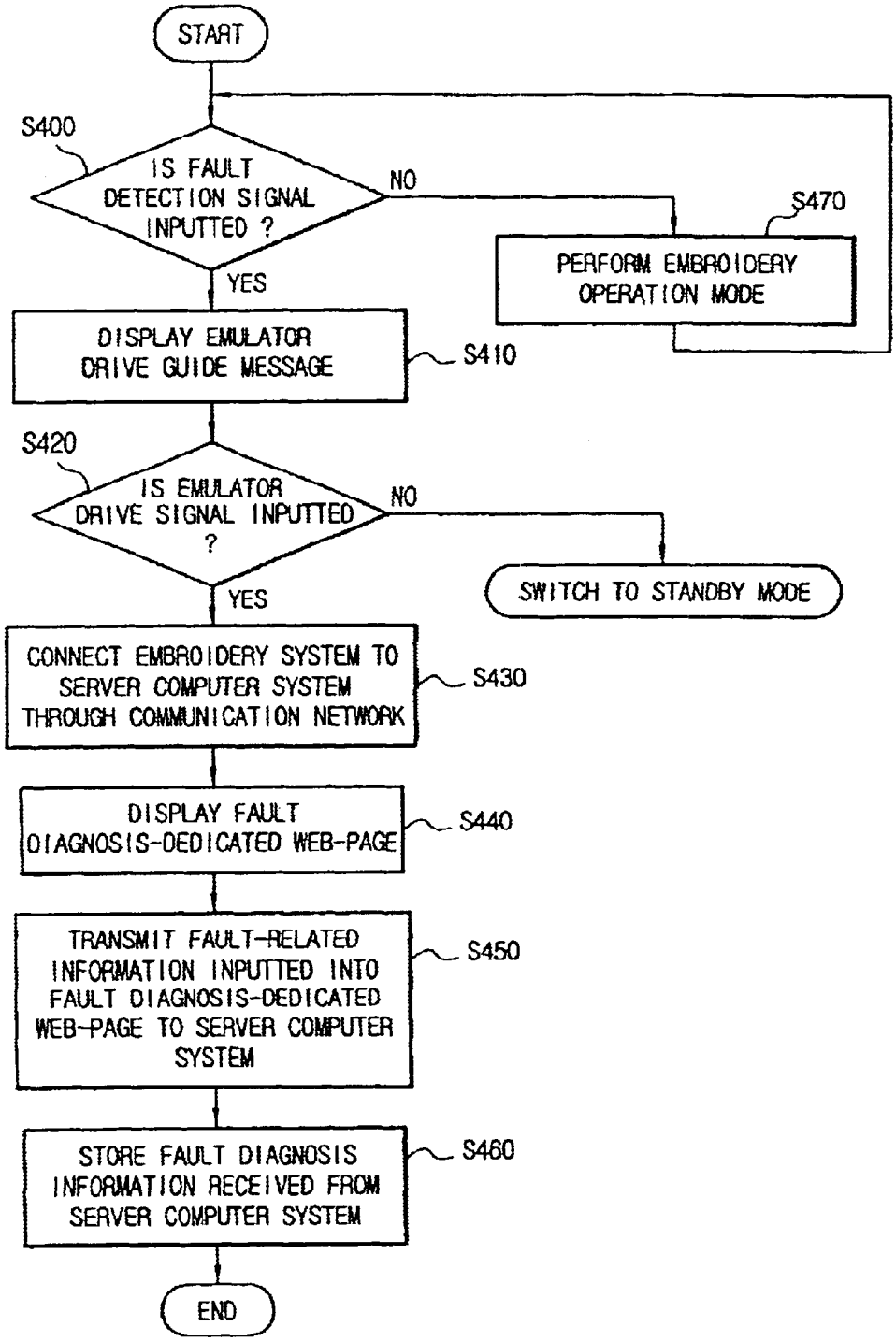
FIG. 4 is a flow chart illustrating an embroidery machine technical support method according to the preferred embodiment of the present invention.

Referring to FIG. 3, the technical support server 300 includes a fault-symptom information database 310, an embroidery-parts information database 320, an information-providing module 330, a communication supporting module 340, and an electronic bulletin board module 350.

The fault-symptom information database 310 classifies and stores the fault symptom information inputted into the technical support page by the user. The embroidery-parts information database 320 classifies and stores an embroidery-parts information of embroidery parts configuring the embroidery machine 200. The information-providing module 330 provides the technical support page to the embroidery machine 200 and provides the fault symptom information to the fault-symptom information database 310. The communication-supporting module 340 supports a communication between the user at the embroidery machine 200 and a system administrator at technical support server 300. The communication-supporting module 340 also supports a chatting and a moving picture for the sake of the communication between the user at the embroidery machine 200 and the system administrator at the technical support server 300 so that the fault of the embroidery machine 200 is diagnosed using a chatting and a moving picture. The electronic bulletin board module 350 registers an embroidery-part purchase request message and the embroidery fault diagnosis request message inputted by the user, and also registers a response message, with respect to the embroidery-part purchase request message and the embroidery fault diagnosis request message, to provide the user with the response message.

Figure 6:
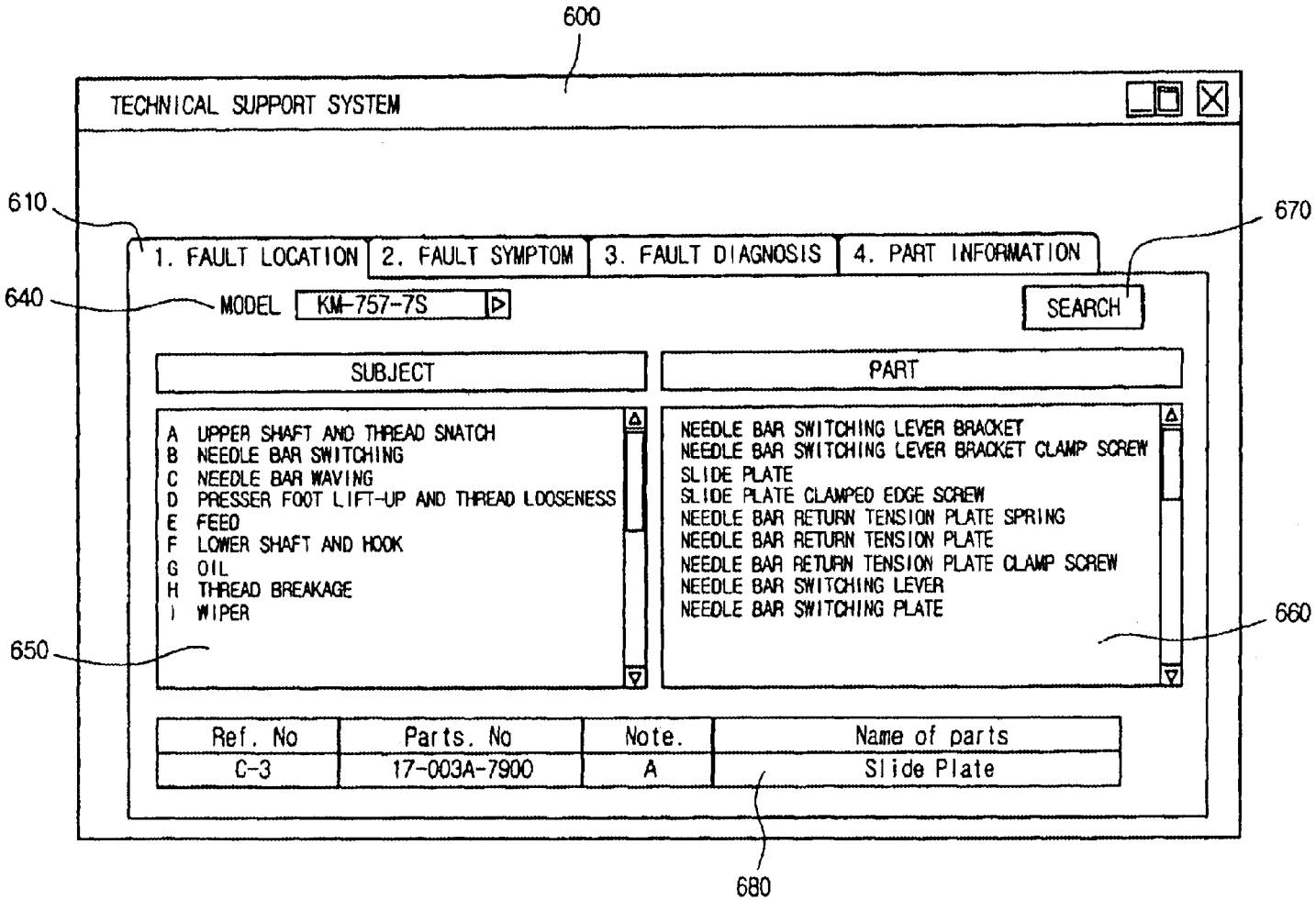
FIG. 6 is an exemplary view illustrating a technical support page provided by the technical support server shown in FIG. 1 when a fault location search page is activated by selecting a search tap on the interface.
Figure 7:
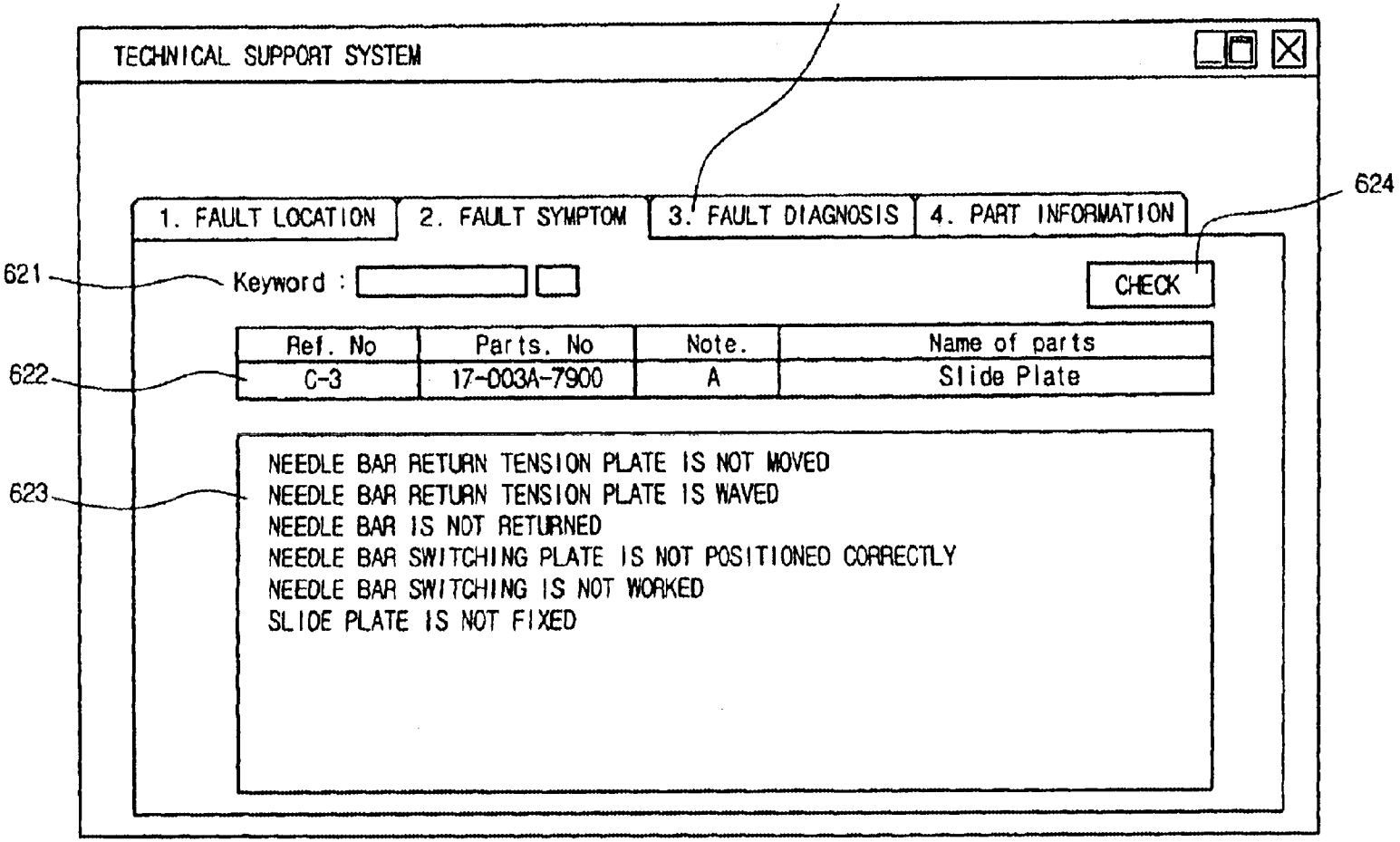
FIG. 7 is an exemplary view illustrating the technical support page of FIG. 6 when a symptom-providing page is activated by selecting a symptom tap on the technical support page.
Figure 8:
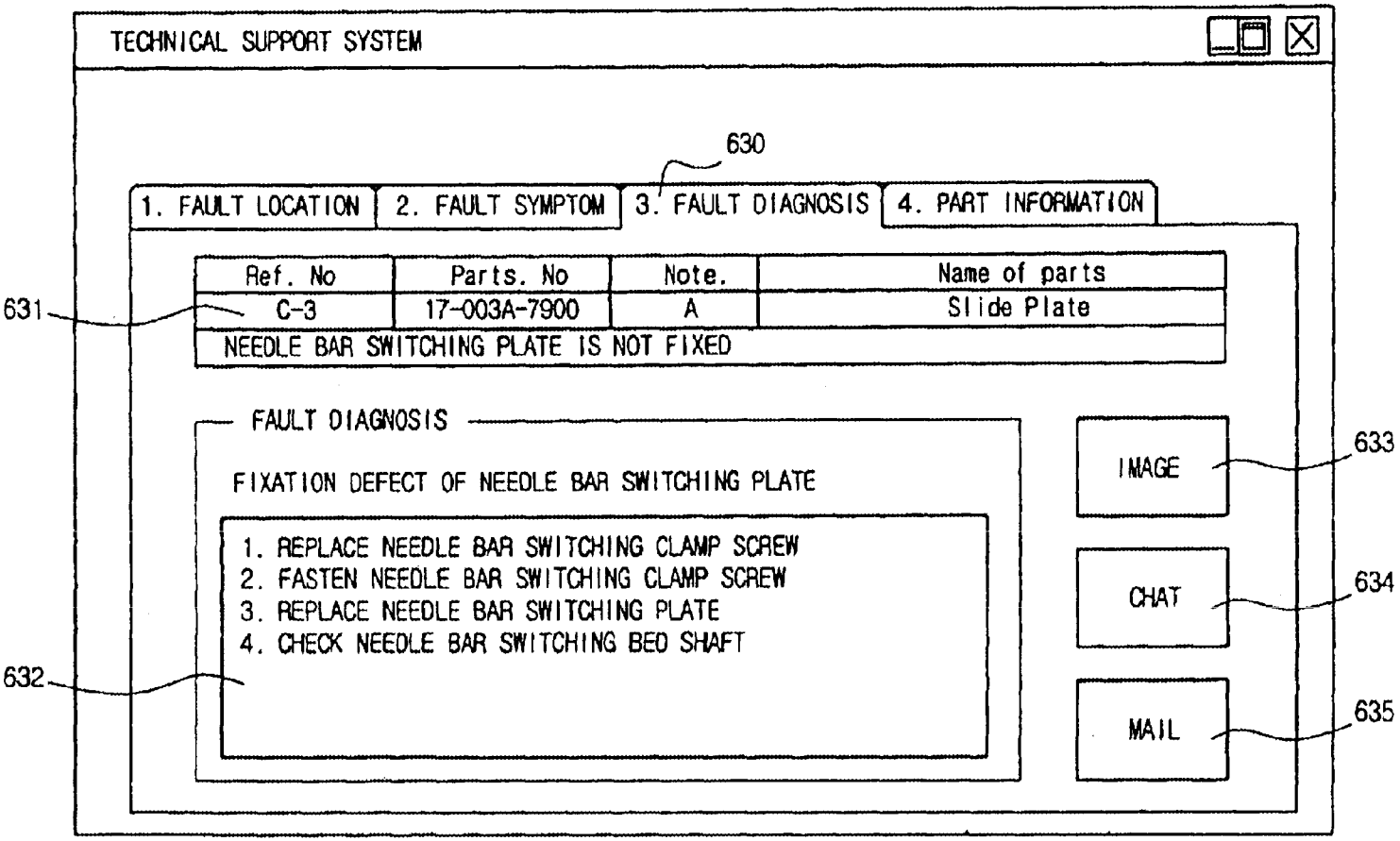
FIG. 8 is an exemplary view illustrating the technical support page of FIG. 6 when a fault diagnosis page is activated by selecting a diagnosis tap on the technical support page.
Figure 9:
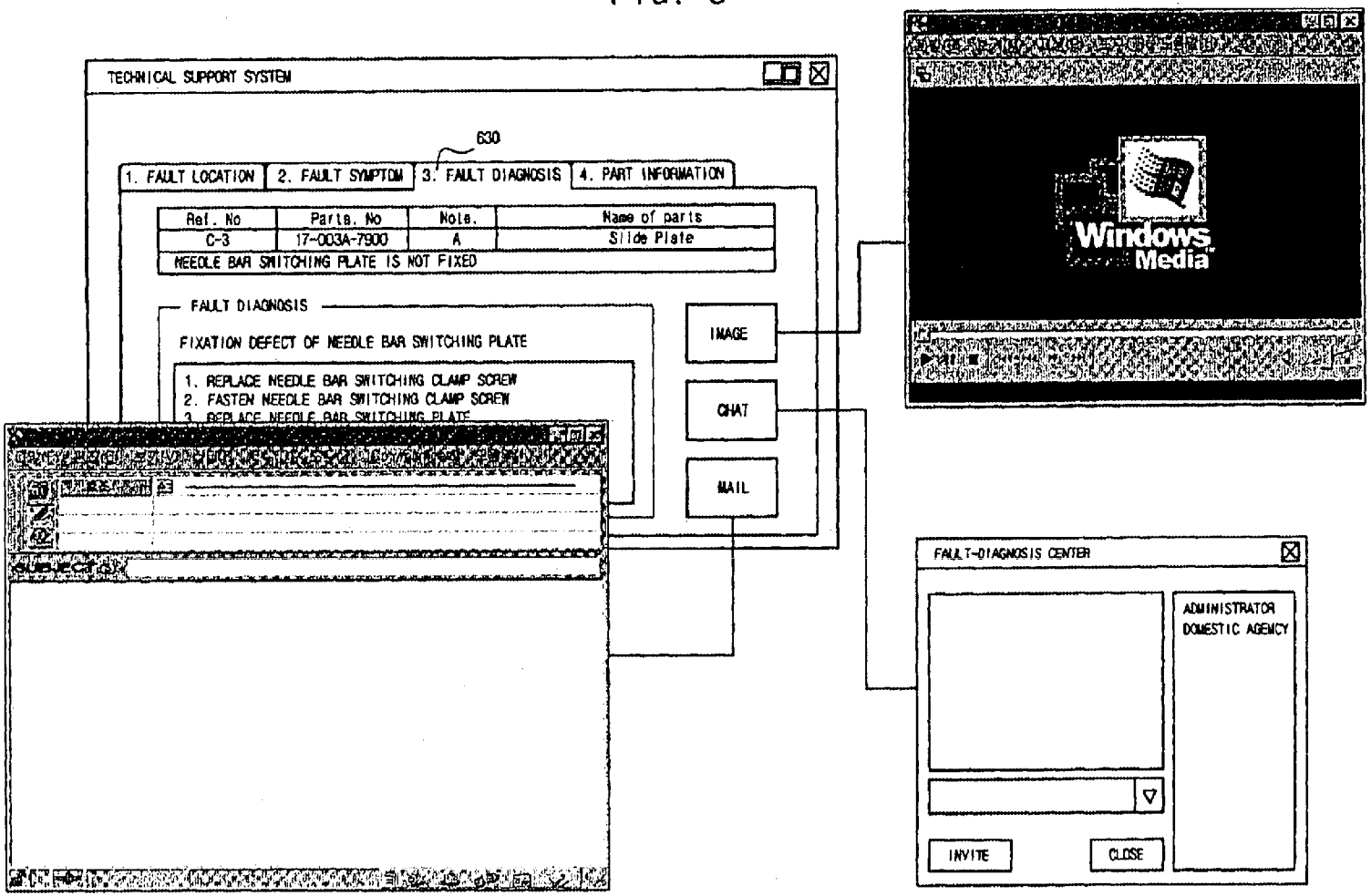
FIG. 9 is an exemplary view illustrating the web page together with linked program windows when linked program buttons of the web page are clicked.

Referring to FIGS. 6 to 8, the technical support web page 600 includes a fault location search page 610, a fault symptom-providing page 620, a fault diagnosis page 630, and a part information page 645.

In FIG. 6, the fault location search page 610 provides a fault part list 660 to indicate the fault location. The fault location search page 610 includes a model name list box 640, a fault subject box 650, a fault part list box 660, and a search button 670. The fault subject box 650 displays a list of fault subject names. The fault part list box 660 displays fault embroidery-part names when the user selects one fault subject name in the list of the fault subject names. If the search button 670 is clicked, the fault symptom-providing page 620 provides a fault symptom list. The fault symptom-providing page 620 is linked to the fault diagnosis page 630 providing a fault diagnosis message.

Referring to FIG. 8, the fault diagnosis page 630 includes a moving picture menu item 633, a chatting menu item 634, and an e-mail menu item 635. The moving picture menu item 633 is clicked by the user so that a moving picture of a fault processing, accomplished by the system administrator at the technical support server 300, is provided. The chatting menu item 634 is clicked by the user so that the communication between the user and the system administrator is accomplished in a real-time chatting. The e-mail menu item 635 is clicked by the user so that the user can communicate with the system administrator in an e-mail.

The web page 600 further includes part information page 645, which displays specification of a selected part when a model and a part of the embroidery machine 200 of that model is selected.

As shown in FIG. 10 to FIG. 13, the part information page 645 is provided with a view frame 642 for showing an exploded perspective view of a module of the embroidery machine consisted of a plurality of parts, a drawing control bar 641 for adjusting the drawing presently displayed in the drawing display frame, a title section 643 for displaying title of the module presently displayed in the drawing display frame, a part list frame 644 for listing the names of the parts displayed in the view frame 642.

For example, when the user selects 'main relief valve and safety valve,' its parts such as housing, plug taper, and valves are listed in the part list frame 644 and displayed in the view frame 642.

Each part name listed in the part list frame 644 is hyperlinked with a corresponding specification web page informing details of the part such that the user can open the specification web page by clicking the corresponding part name.

Also, the part information page 645 is provided with a manual display such that the user can obtain how to solve a problem when a part is damaged.

The operation of the above structured embroidery machine technical support system will be described hereinafter.

Once the embroidery machine 200 is on, the controller 230 initializes the embroidery machine 200.

When receiving the user input signal from the input unit 240 or the fault detection signal generated by the fault detector 220, the controller 230 activates the emulator 211 so as to establish connection with the technical support server 300. If the connection is established, the technical support server 300 sends the technical support page to the embroidery machine 200 such that the user fills out the request form and sends the request to the technical support server 300. Consequently, the technical support server 300 responsively sends corresponding requested information to the embroidery machine 200.

Figure 10:
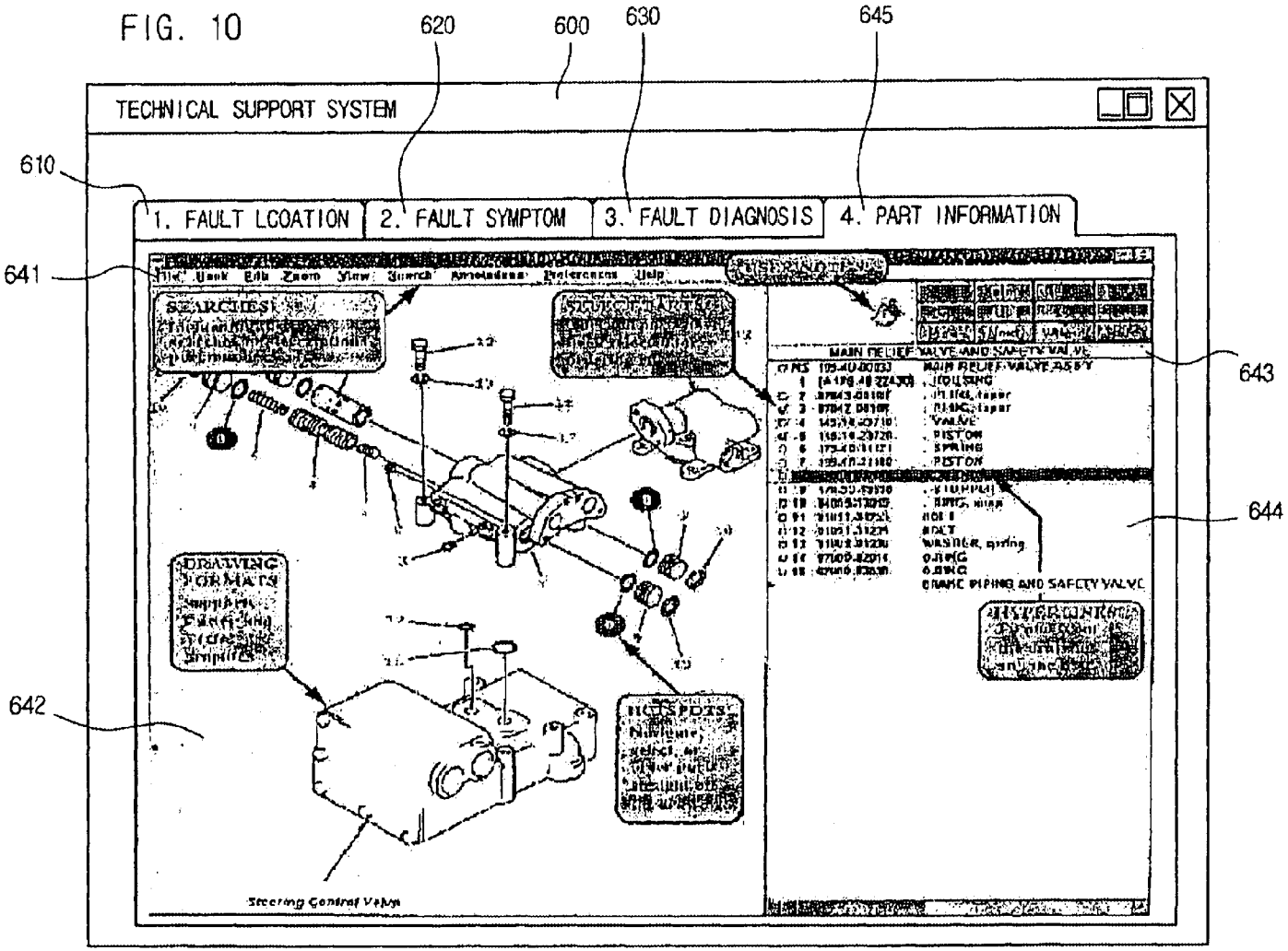
FIG. 10 is an exemplary view illustrating the web page of FIG. 6 when a part information page is activated by selecting a part information tap on the technical support page.
Figure 11:
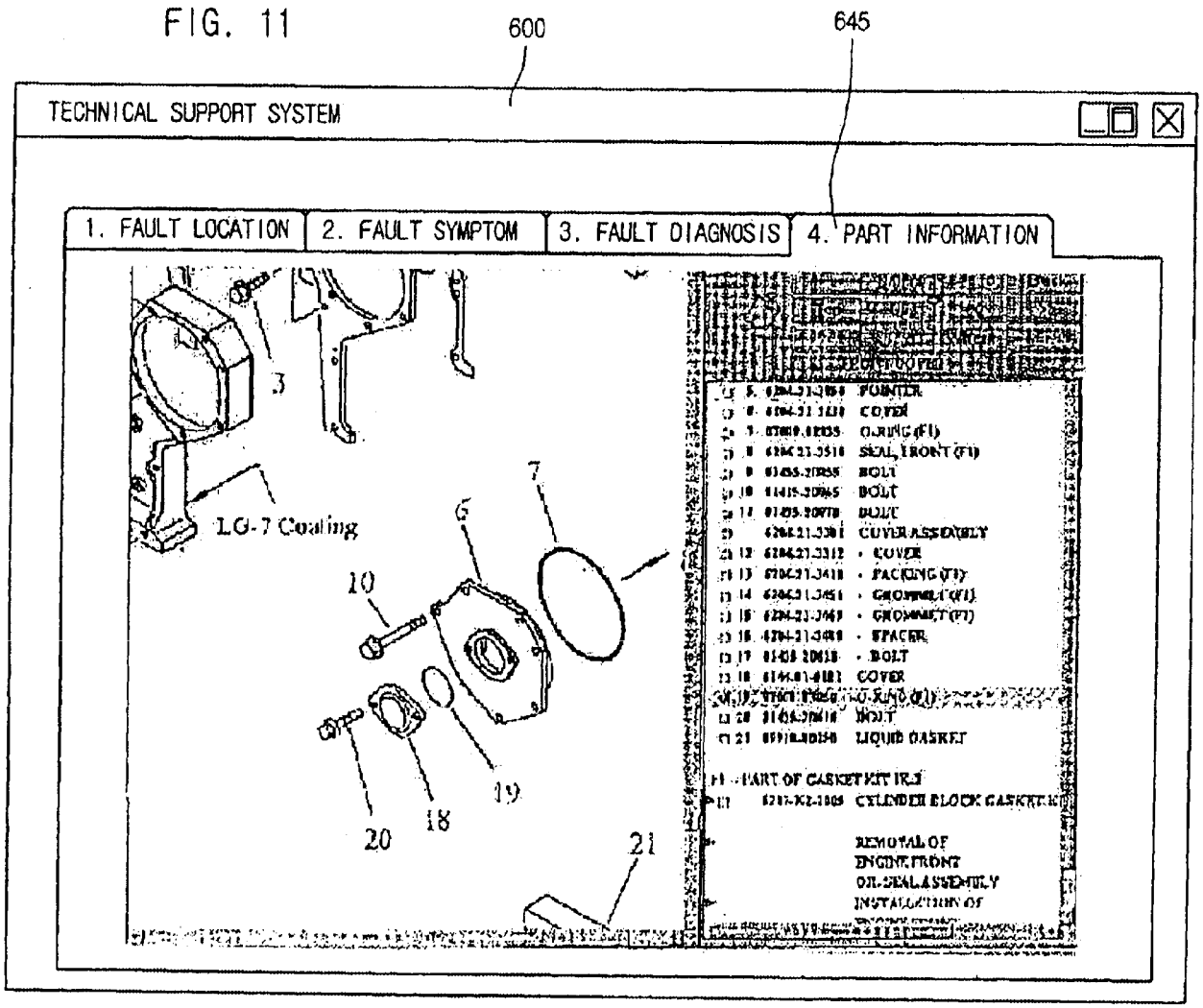
FIG. 11 is an exemplary view for illustrating how the part information is provided on the part information page of FIG. 10.
Figure 12:
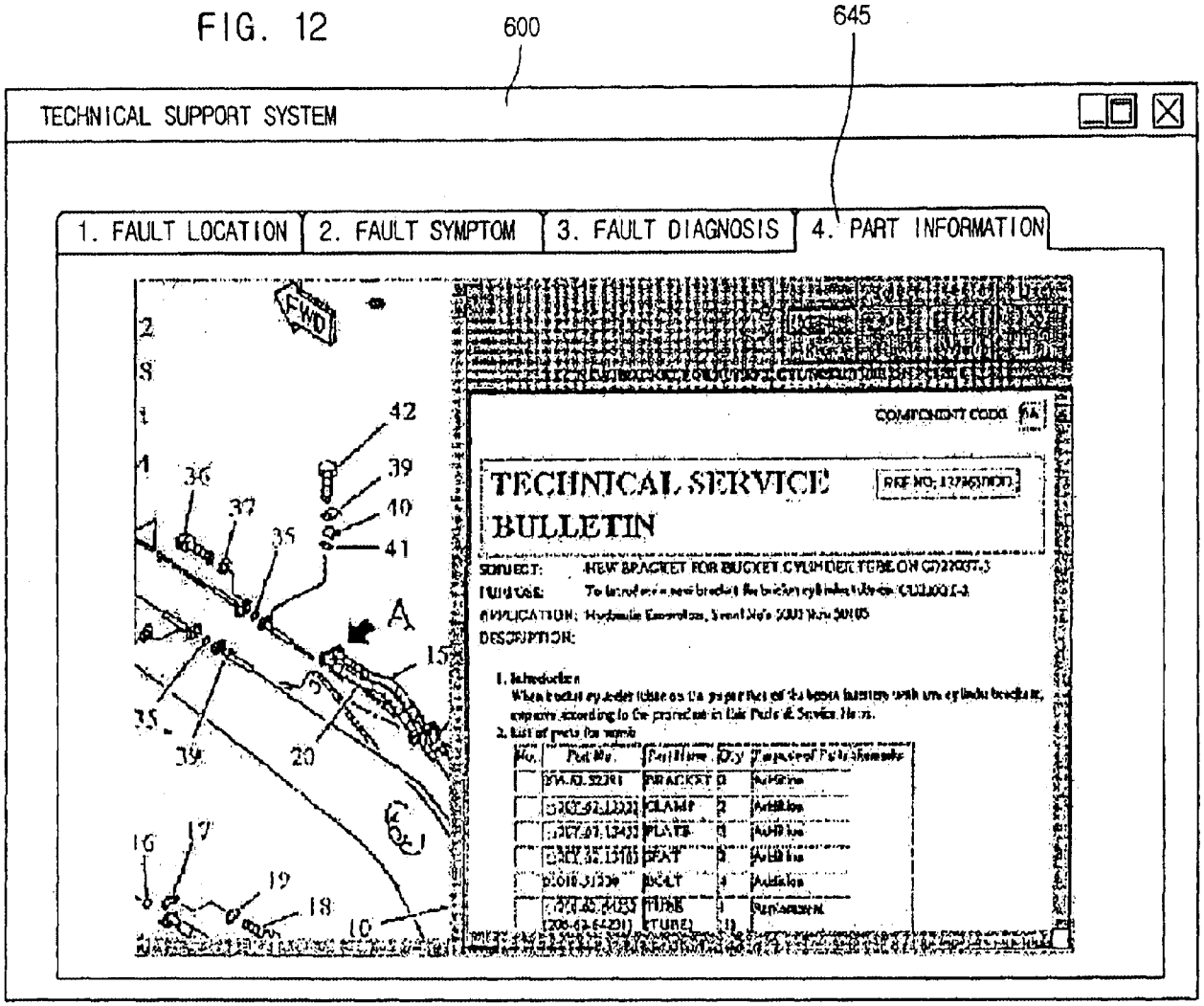
FIG. 12 is an exemplary view for illustrating how technical information is provided on the part information page of FIG. 10.
Figure 13:
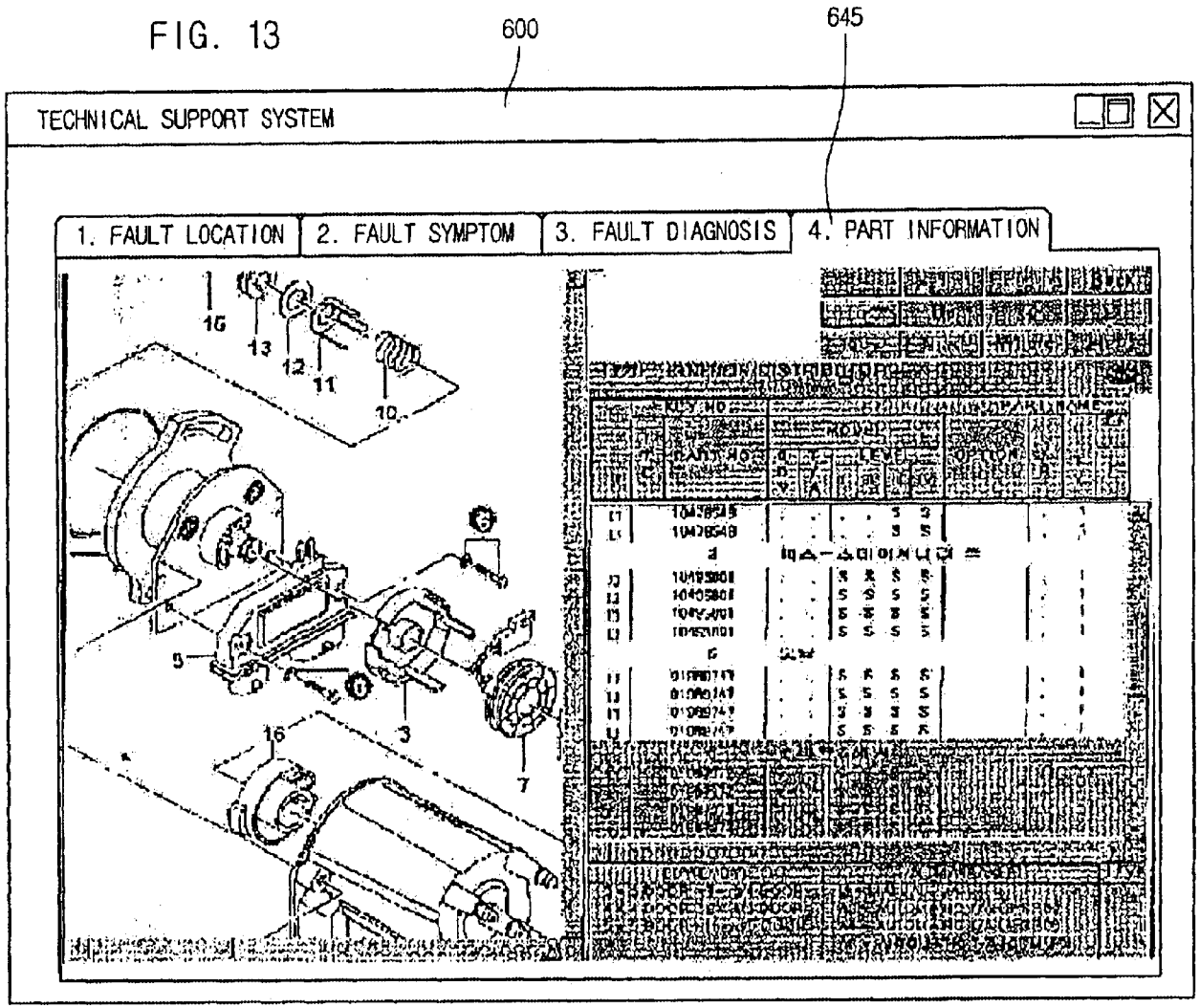
FIG. 13 is an exemplary view for illustrating how detail information of each part is provided on the part information page of FIG. 10.

If the user selects a model of the embroidery machine in the model name box 640 and enters a name of a module of the embroidery machine in the title section 643, the parts consisting of the selected module of the specific machine are listed in the part list frame 644 and displays the module as an exploded perspective view in the view frame 642 (see FIG. 10).

If a part is selected in the part list frame 642, the specification of the selected part is provided by the technical support server 300.

Also, the technical support server 300 is provided with the manual through the part information service page such that when the embroidery machine 200 is malfunctioning, the user can troubleshoot the problem.

Referring to FIGS. 2 to 8, there is shown a fault diagnosis method for diagnosing a fault of the embroidery machine.

First, if the user presses a turn-on key to start the embroidery operation with the input unit 240, the controller 230 initializes the embroidery machine 200. At step S400, the controller 230 determines whether there is a fault detection signal received from the fault detector 220. If there is not the fault detection signal received from the fault detector 220, at step S470, the embroidery machine 200 performs an embroidery operation mode.

Otherwise, if there is a fault detection signal received from the fault detector 220, at step S410, the display unit 250 displays the emulator drive guide message through the controller 230.

At step S420, the controller 230 determines whether there is the emulator drive signal received from the input unit 240. If there is not the emulator drive signal received from the input unit 240, the embroidery machine 200 is switched to a standby mode.

Otherwise, if there is the emulator drive signal received from the input unit 240, at step S430, the embroidery machine 200 is connected to the technical support server 300 through the communication network 100.

At step S440, the display unit 250 displays the technical support web page 600 from the technical support server 300 through the communication interface 260.

The user inputs the technical support information of the embroidery machine 200 into the technical support web page 600. At step S450, the communication interface 260 transmits the technical support information inputted into the technical support web page 600 from the embroidery machine 200 to the technical support server 300. At step S460, the technical support server 300 diagnoses the fault of the embroidery machine by employing the technical support information inputted into the fault diagnosis-detected web page 600. Then, the technical support server 300 generates and transmits the technical support information to the embroidery machine 200. Further, the embroidery machine 200 stores the technical support information in the storage 210.

The steps S450 and S460 are explained in detail in FIGS. 6 to 8. First, referring to FIG. 6, the controller 230 controls the display unit 250 for displaying the technical support web page 600 from the technical support server 300 through the communication interface 260.

At the fault location search page 610, the user selects the model name in the model name list box 640. Then, the fault subject list box 650 displays the fault subject list automatically in response to the inputted the model name. In case that the user selects the fault subject at the fault subject list box 650, the fault part list box 660 displays the fault part list in response to the selected fault subject automatically. After selecting the fault embroidery-part in the fault parts list box 660, the user clicks the search button 670. Then, the fault symptom-providing page 620 is displayed. The fault location search page 610 also includes a table 680. The table 680 is composed of 4 boxes, which are Ref.No.box, Parts No.box, Note box, and Name of parts box. The table 680 is filled out automatically in response to the selected technical support information at the fault location search page 610.

Referring to FIG. 7, the fault symptom providing page 620 includes a keyword input box 621, a table 622, a fault symptom list box 623, and a check button 624. The fault symptom list box 623 displays a fault symptom list in response to the inputted information into the fault location page 610. In case that the user inputs a keyword into the keyword inputting box 621, the fault symptom list box 623 displays the fault symptom list in response to the inputted keyword. The table 622 is the same as the table 680 of the fault location page 610. After the fault symptom list box 623 displays the fault symptoms, the user selects the fault symptom of the embroidery machine 200, and the check button 624. Then the fault diagnosis page 630 is displayed.

Referring to FIG. 8, the fault diagnosis page 630 includes a table 631, and a fault diagnosis box 632, an image menu item 633, a chatting menu item 634, and 12. an e-mail menu item 635.

The table 631 includes 5 boxes. Ref.No.Box, Parts No.box, Note box, and Name of parts box display (the same as the table 680 and the table 622). A fault symptom box displays the selected fault symptom of the embroidery machine 200 in the fault symptom-providing page 620. The fault diagnosis box 632 displays a fault diagnosis list in response to the inputted information of the fault symptom page 620. Finally, the technical support information is transmitted from the technical support server 300 to the embroidery machine 200. The technical support information is transmitted in the form of a moving picture file, image file and/or a document. Also the user communicates with the system administrator at the technical support server 300. The moving picture menu item 633 provides the moving picture of a fault processing accomplished by the system administrator at the technical support server 300. The user also produces the technical support information in the form of the moving picture file with a video tape recorder or a digital still camera, and transmits the technical support information in the form of the moving picture file to the technical support server 300. The chatting menu item 634 provides a real-time chatting so that the communication between the user and the system administrator is accomplished. The e-mail menu item 635 provides an e-mail so that the user can communicate with the system administrator. Thus, the system administrator transmits the technical support information from the technical support server 300 to the embroidery machine 200.

In the meantime, the technical support server 300 provides the technical support information to the embroidery machine 200. Namely, referring to FIGS. 6 to 8, the technical support server 300 must program the technical support web page for providing the technical support information, which includes the fault location search page 610, the fault symptom providing page 620, and the fault diagnosis page 630. Furthermore, the service computer system 300 shall include the fault symptom database 310, the embroidery-parts information database 320, the information providing module 330, the communication supporting module 340, and the electronic bulletin board module 350.

Figure 5:
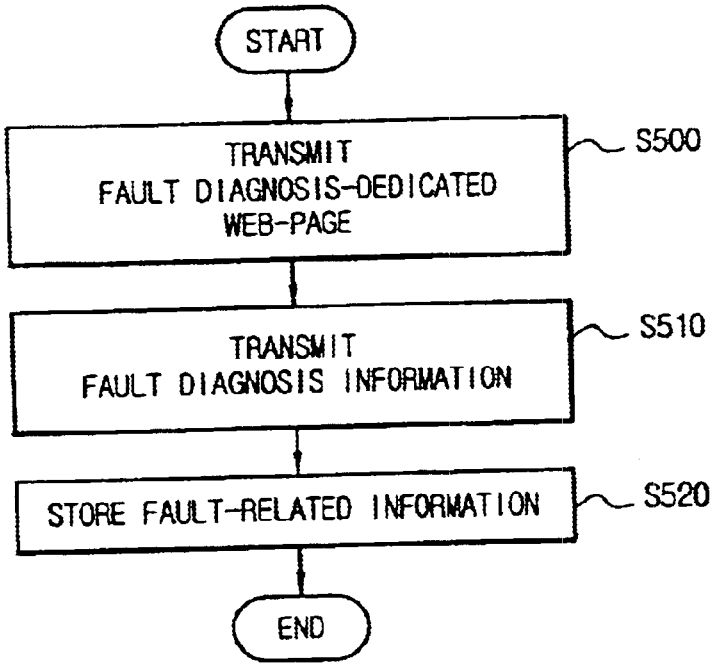
FIG. 5 is a flow chart illustrating an operation of the technical support server of FIG. 3.

Referring to FIG. 5, there is shown the fault diagnosis method for diagnosing the fault of the embroidery machine at technical support server 300. At step S500, the information-providing module 330 transmits the technical support web page from the technical support server 300 to the embroidery machine 200 in response to the emulator drive signal inputted by the user. The user, at step S510, inputs the technical support information into the technical support web page, then the information providing module 330 provides the fault symptom information to the database. At step S520, the information providing module 330 operates with the communication supporting module 340 and the electronic bulletin board module 350 in sequence operation, and the electronic bulletin board module 350 stores the technical support information in the fault symptom information database 320, which is inputted from the embroidery machine.

In case that the embroidery machine operation software is updated, the technical support server 330 informs the embroidery machine 200 of the software update such that the embroidery machine 200 automatically or manually downloads the embroidery machine operation software of the new version and updates the old one.

Figure 14:
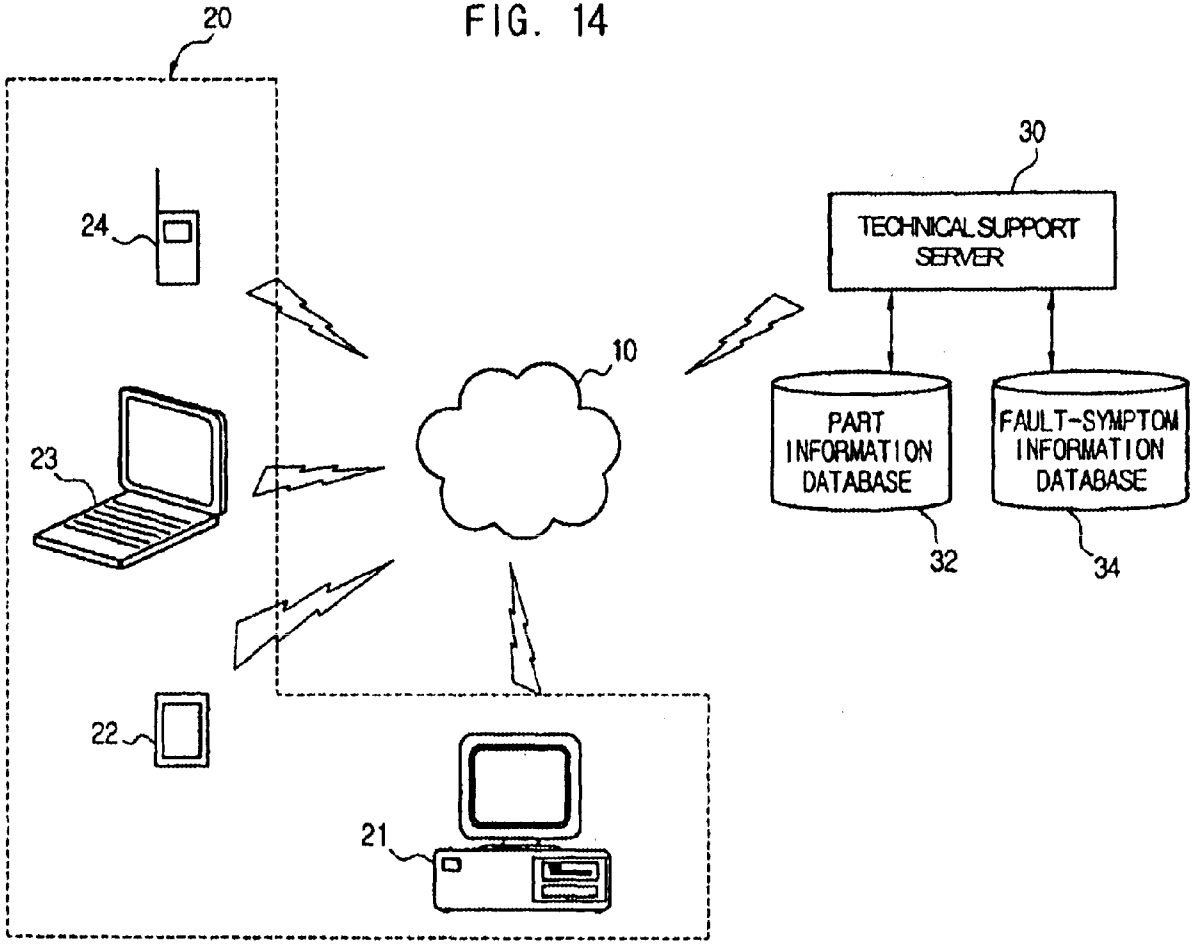
FIG. 14 is a schematic view showing how a user obtains technical information on the embroidery machine from the technical support server through a public network using a personal communication terminal.

As shown in FIG. 14, the emulator can be installed in a personal computer (PC) 21, personal digital assistant (PDA) 22, notebook PC 23, and mobile phone such that the user can usually obtained the same technical information from the technical support server 300 through data communication network.

As described above, since the embroidery machine is provided with the emulator in order for the embroidery machine to communicate with the technical support server, the user can obtain technical information on the embroidery machine from the remote technical support server in real time.

Also, the user of an embroidery machine can communicate with the system administrator using various tools such as drawings and motion pictures of the concerned parts of the embroidery machine, online chatting, and etc. such that the user can troubleshoot the present problem of the embroidery machine without a time consuming visit of the serviceman, resulting in reduction of the repairing time and enhancing the operation efficiency of the embroidery machine.

Furthermore, even though it is needed that the serviceman should visit for repairing the embroidery machine, the serviceman can reliably prepare the parts and devices needed to solve the problem of the embroidery machine.

Still more, the user can usually obtain various information on the embroidery machine and learn the specification and troubleshooting methods, and the user can get the ability for solving the trivial problems or malfunctioning of the embroidery machine, resulting in enhancement of work efficiency.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. An embroidery machine technical support system comprising:

at least one technical support server; and a plurality of embroidery machines communicating with the technical support server through a public network, wherein each embroidery machine has an emulator in order for the embroidery machine to establish connection to the technical support server through the public network, receive a technical support page from the technical support server, send a technical information request signal to the technical support server using the technical support page, receive corresponding technical information from the technical supporter server, and the technical support server sends the technical support page when the embroidery machine establishes connection with the technical support server and sends technical information in response to the technical information request signal from the embroidery machine.

2. A embroidery machine technical support system of claim 1 wherein the embroidery machine comprises: a storage containing embroidery operation programs and an emulator for connecting the embroidery machine to the technical support server;

an input unit for inputting user's instruction so as to operate the embroidery operation programs and the emulator;

a controller for the embroidery machine;

a display unit for displaying operation status of the embroidery machine and the technical support page from the technical support server;

a communication interface for supporting data communication between the embroidery machine and the technical support server.

3. An embroidery machine technical support system of claim 2 wherein the embroidery machine further comprises an error detector for detecting an error of the embroidery machine when the embroidery machine is malfunctioning and sending an error signal to the controller such that the controller displays an error message on the display unit and operates the emulator on the basis of user's instruction.

4. An embroidery machine technical support system of claim 3 wherein the emulator displays a message whether or not to establish connection to the technical support server, establish connection to the technical support server if the user instructs connection establishment, and display a technical support page received from the technical support server.

5. An embroidery machine technical support system of claim 4 wherein the controller sends a technical support request inputted through the technical support page to the technical support server and stores the information received from the support server.

6. An embroidery machine technical support system of claim 5 wherein the technical support information includes one of a moving picture file, an image file, and a document.

7. An embroidery machine technical support system of claim 6 wherein the technical support information is produced by a video tape recorder or a digital still camera.

8. An embroidery machine technical support system of claim 7 wherein the technical support information is stored in the storage means and reproduced on the display unit.

9. An embroidery machine technical support system of claim 6 wherein the technical support information is produced using a scanner.

10. An embroidery machine technical support system of claim 1 wherein the technical support server comprises:

a fault-symptom information database for classifying and storing fault symptom information inputted into the technical support page by the user; and information providing means for providing the technical support page to the embroidery machine and providing the fault symptom information to the database.

11. An embroidery machine technical support system of claim 10 wherein the technical support server further comprises an embroidery-parts information database for classifying and storing embroidery-parts information of the embroidery parts configuring the embroidery machine.

12. An embroidery machine technical support system of claim 10 wherein the technical support server further comprises a communication supporting means for supporting a communication between the user at the embroidery machine and a system administrator at the technical support server.

13. An embroidery machine technical support system of claim 12 wherein the communication supporting means supports a chatting and a moving picture for the sake of the communication between the user at the embroidery machine and the system administrator at the technical support server so that the fault of the embroidery machine is diagnosed through a chatting and a moving picture.

14. An embroidery machine technical support system of claim 10 wherein the technical support server further comprises an electronic bulletin board for registering an embroidery-part purchase request message and an embroidery fault diagnosis request message inputted by the user, and registering a response message, with respect to the embroidery-part purchase request message and the embroidery fault diagnosis request message, to provide the user with the response message.

15. An embroidery machine technical support system of claim 1 wherein the technical support page includes a part information service page for displaying specification of a selected part when a model and part name of the embroidery machine is selected.

16. An embroidery machine technical support system of claim 15 wherein the part information service page comprises:

a view frame for showing an exploded perspective view of a module of the embroidery machine consists of a plurality of parts;

a title section for displaying title of the module presently displayed in the view frame; and a part list frame for listing the names of the parts displayed in the view frame.

17. An embroidery machine technical support system of claim 16 wherein each part name listed in the part list frame is hyperlinked with a corresponding specification web page informing details of the part.

18. An embroidery machine technical support system of claim 16 wherein the part information service page is provided with a manual display for displaying a manual of the embroidery machine and it parts.

19. An embroidery machine technical support system of claim 1 wherein the technical support page includes:

a fault location search page for providing a fault part list to indicate the fault location after selecting an embroidery machine model name and a fault subject name;

a fault symptom providing page for providing a fault symptom list when the user selects one fault embroidery-part in the fault part list and a search button on the fault location search page; and a fault diagnosis page for providing a fault diagnosis message when the user selects one fault symptom in the fault symptom list and a check button on the fault symptom-providing page.

20. An embroidery machine technical support system of claim 19 wherein the technical support page includes a moving picture menu item for providing a moving picture of a fault processing accomplished by a system administrator at the technical support server.

21. An embroidery machine technical support system of claim 19 wherein the technical support page includes a chatting menu item for providing a real-time chatting so that the communication between the user and the system administrator is accomplished.

22. An embroidery machine technical support system of claim 19 wherein the technical support page includes an e-mail menu item for providing an e-mail so that the user can communicate with the system administrator.

23. An embroidery machine technical support method comprising the steps of:

establishing connection between an embroidery machine and a technical support server;

transmitting, with the technical support server, a technical support page to the embroidery machine;

transmitting, with the embroidery machine, a technical support request to the technical support server through the technical support page; and transmitting, with the embroidery machine, corresponding technical information in response to the technical support request from the embroidery machine.

24. An embroidery machine technical support method of claim 23 further comprises a step of displaying a message on a display unit asking whether or not to establish connection with the technical support server.

25. An embroidery machine technical support method of claim 24 further comprises a step of storing the technical support information from the technical support server in a storage medium.

26. An embroidery machine technical support method of claim 24 wherein the technical support information includes one of a moving picture file, an image file and a document.

27. An embroidery machine technical support method of claim 26 wherein the technical information is provided to the user by displaying the technical information on a display unit.

28. An embroidery machine technical support method of claim 26 wherein technical support information is produced by a video tape recorder or a digital still camera.

29. An embroidery machine technical support method of claim 26 wherein technical support information is provided by a scanner.

30. An embroidery machine technical support method of claim 23 further comprises a step of supporting a communication between the user at the embroidery machine and a system administrator at the technical support server.

31. An embroidery machine technical support method of claim 30 wherein the communication supporting step includes supporting a chatting and a moving picture for the sake of the communication between the user at the embroidery machine and the system administrator at the technical support server so that the fault of the embroidery machine is diagnosed through a chatting and a moving picture.

32. An embroidery machine technical support method of claim 23 further comprises a step of registering an embroidery-part purchase request message and an embroidery fault diagnosis request message inputted by the user, and registering a response message, with respect to the embroidery-part purchase request message and the embroidery fault diagnosis request message, to provide the user with the response message.

33. An embroidery machine technical support method of claim 23 wherein the technical support page includes a part information service page for displaying specification of a selected part when a model and part name of the embroidery machine is selected.

34. An embroidery machine technical support method of claim 33 wherein a view frame for showing an exploded perspective view of a module of the embroidery machine consists of a plurality of parts;

a title section for displaying title of the module presently displayed in the view frame; and a part list frame for listing the names of the parts displayed in the view frame.

35. An embroidery machine technical support method of claim 34 wherein each part name listed in the part list frame is hyperlinked with a corresponding specification web page informing details of the part.

36. An embroidery machine technical support method of claim 35 wherein the part information service page is provided with a manual display for displaying a manual of the embroidery machine and its parts.

37. An embroidery machine technical support method of claim 23 wherein technical support page includes:

a fault location search page for providing a fault part list to indicate the fault location after selecting an embroidery machine model name and a fault subject name;

a fault symptom providing page for providing a fault symptom list when the user selects one fault embroidery-part in the fault part list and a search button on the fault location search page; and a fault diagnosis page for providing a fault diagnosis message when the user selects one fault symptom in the fault symptom list and a check button on the fault symptom-providing page.

38. An embroidery machine technical support method of claim 37 wherein technical support page includes a moving picture menu item for providing a moving picture of a fault processing accomplished by a system administrator at the technical support server.

39. An embroidery machine technical support method of claim 38 wherein the technical support page includes a chatting menu item for providing a real-time chatting so that the communication between the user and the system administrator is accomplished.

40. An embroidery machine technical support method of claim 39 wherein the technical support page includes an e-mail menu item for providing an e-mail so that the user can communicate with the system administrator.

41. A computer readable storage medium stored an embroidery machine technical support program, the program comprises the processes of:

establishing connection between an embroidery machine and a technical support server;

transmitting, with the technical support server, a technical support page to the embroidery machine;

transmitting, with the embroidery machine, a technical support request to the technical support server through the technical support page; and transmitting, with the embroidery machine, corresponding technical information in response to the technical support request from the embroidery machine.

42. A computer readable storage medium of claim 41 wherein the embroidery machine technical support program further comprises a process of displaying a message on a display unit asking whether or not to establish connection with the technical support server.

43. A computer readable storage medium of claim 42 wherein the embroidery machine technical support program further comprises a process of storing the technical support information from the technical support server in a storage medium.

44. A computer readable storage medium of claim 42 wherein the technical support information includes one of a moving picture file, an image file and a document.

45. A computer readable storage medium of claim 44 wherein the technical information is provided to the user by displaying the technical information on a display unit.

46. A computer readable storage medium of claim 44 wherein the technical support information is produced by a video tape recorder or a digital still camera.

47. A computer readable storage medium of claim 44 wherein technical support information is provided by a scanner.

48. A computer readable storage medium of claim 41 further comprises a process of supporting a communication between the user at the embroidery machine and a system administrator at the technical support server.

49. A computer readable storage medium of claim 48 wherein the communication supporting process includes supporting a chatting and a moving picture for the sake of the communication between the user at the embroidery machine and the system administrator at the technical support server so that the fault of the embroidery machine is diagnosed through a chatting and a moving picture.

50. A computer readable storage medium of claim 41 wherein the method further comprises a process of registering an embroidery-part purchase request message and an embroidery fault diagnosis request message inputted by the user, and registering a response message, with respect to the embroidery-part purchase request message and the embroidery fault diagnosis request message, to provide the user with the response message.

51. A computer readable storage medium of claim 41 wherein the technical support page includes a part information service page for displaying specification of a selected part when a model and part name of the embroidery machine is selected.

52. A computer readable storage medium of claim 51 wherein a view frame for showing an exploded perspective view of a module of the embroidery machine consists of a plurality of parts;

a title section for displaying title of the module presently displayed in the view frame; and a part list frame for listing the names of the parts displayed in the view frame.

53. A computer readable storage medium of claim 52 wherein each part name listed in the part list frame is hyperlinked with a corresponding specification web page informing details of the part.

54. A computer readable storage medium of claim 53 wherein the part information service page is provided with a manual display for displaying a manual of the embroidery machine and it parts.

55. A computer readable storage medium of claim 41 wherein the technical support page includes:

a fault location search page for providing a fault part list to indicate the fault location after selecting an embroidery machine model name and a fault subject name;

a fault symptom providing page for providing a fault symptom list when the user selects one fault embroidery-part in the fault part list and a search button on the fault location search page; and a fault diagnosis page for providing a fault diagnosis message when the user selects one fault symptom in the fault symptom list and a check button on the fault symptom providing page.

56. A computer readable storage medium of claim 55 wherein the technical support page includes a moving picture menu item for providing a moving picture of a fault processing accomplished by a system administrator at the technical support server.

57. A computer readable storage medium of claim 56 wherein the technical support page includes a chatting menu item for providing a real-time chatting so that the communication between the user and the system administrator is accomplished.

58. A computer readable storage medium of claim 57 wherein the technical support page includes an e-mail menu item for providing an e-mail so that the user can communicate with the system administrator.

59. An embroidery machine technical support system comprising:

at least one technical support server, the technical support server providing a technical support page and technical information in response to a technical information request signal through the technical support page;

a plurality of communication terminals communicating with the technical support server through a public network, an embroidery machine having an emulator in order for the embroidery machine to establish connection to the technical support server through the public network, receive a technical support page from the technical support server, send technical information request signal to the technical support server using the technical support page, and receive corresponding technical information from the technical support server.

60. An embroidery machine technical support system of claim 59 wherein the terminal is a personal computer.

* * * * *